United States Patent [19]

Linsén

[11] Patent Number: 4,884,516

[45] Date of Patent: Dec. 5, 1989

[54] INCLINED GRATE APPARATUS FOR USE IN THE COMBUSTION CHAMBER OF A COMBUSTION FURNACE

[75] Inventor: Lauri G. Linsén, Rantasalmi, Finland

[73] Assignee: A. Ahlstrom Corporation, Noormarkku, Finland

[21] Appl. No.: 277,822

[22] Filed: Nov. 30, 1988

[30] Foreign Application Priority Data

Dec. 22, 1987 [FI] Finland ..... 875648

[51] Int. Cl.[4] ..... F23H 7/08; F23H 7/14

[52] U.S. Cl. ..... 110/281; 110/285; 110/291; 110/298; 122/289; 122/353; 126/175; 198/774

[58] Field of Search ..... 110/255, 258, 285, 291, 110/281, 282, 283, 284, 298; 122/353, 286, 287, 289, 354; 198/774, 750; 126/153, 154, 175

[56] References Cited

U.S. PATENT DOCUMENTS

| | | | |
|---|---|---|---|
| 544,108 | 8/1895 | Muller | 122/287 |
| 4,246,851 | 1/1981 | Bergh | 110/281 |
| 4,569,437 | 2/1986 | Doerges | 110/281 X |
| 4,586,442 | 5/1986 | Caughey | 110/298 X |
| 4,598,651 | 7/1986 | Flickinger | 110/298 X |
| 4,676,176 | 6/1987 | Bonomelli | 110/291 X |

*Primary Examiner*—Edward G. Favors
*Attorney, Agent, or Firm*—Nixon & Vanderhye

[57] ABSTRACT

An inclined grate construction or apparatus in the combustion chamber of a combustion furnace, comprising a plurality of adjacent grate tubes in the longitudinal direction of the grate, said tubes being welded together through flat bars. Below the grate is disposed a grate bar carriage, which, in use, reciprocates horizontally respective to the grate. The grate bar carriage supports at least one grate bar, which is pushed through the grate via an opening in the flat bar between two adjacent grate tubes when the grate bar carriage moves towards the grate. The grate bar carriage is also vertically displaceable.

13 Claims, 4 Drawing Sheets

Figure 1:
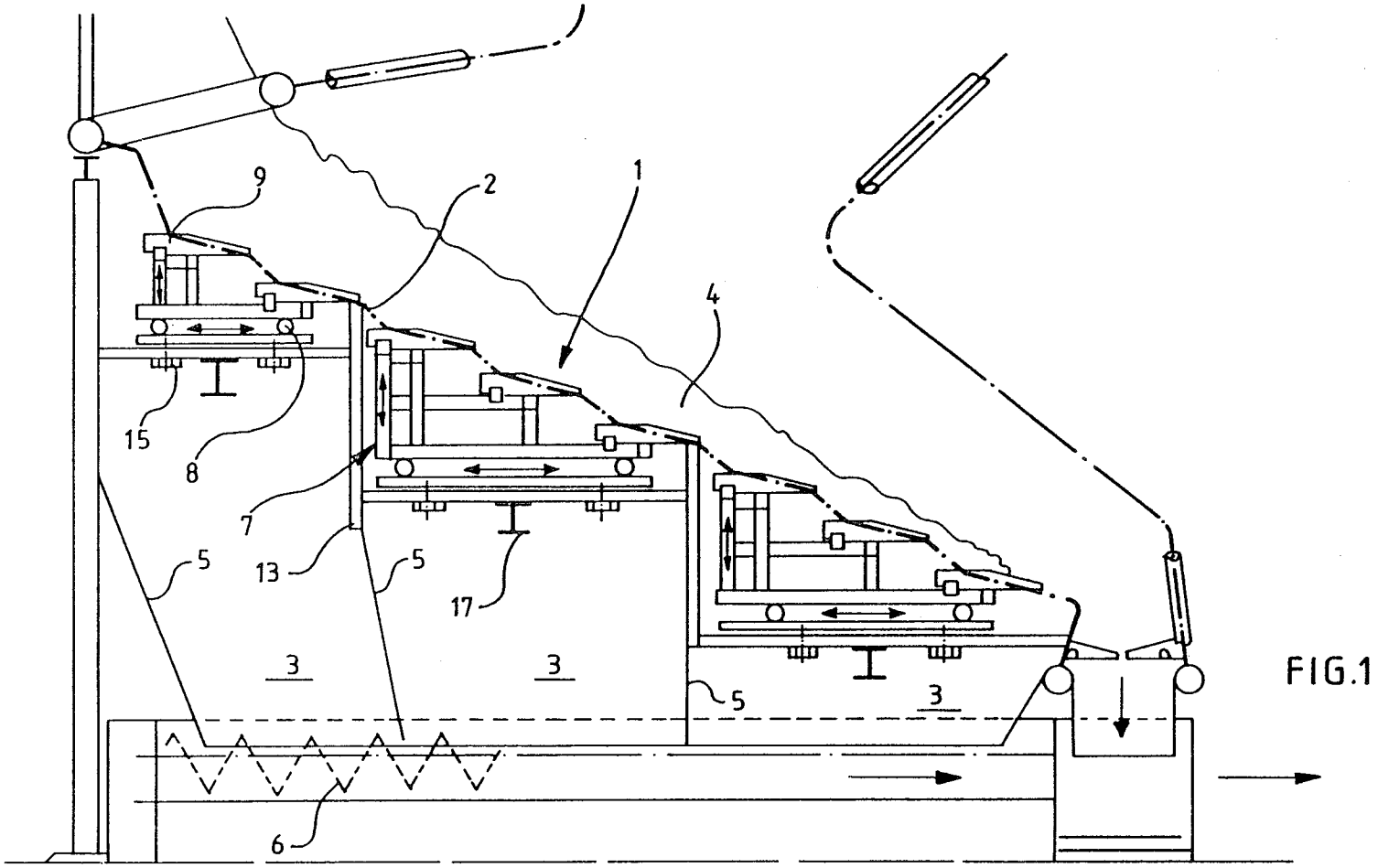

INCLINED GRATE APPARATUS FOR USE IN THE COMBUSTION CHAMBER OF A COMBUSTION FURNACE

The present invention relates to an inclinded grate apparatus for use in the combustion chamber of a combustion furnace, in which grate apparatus the grate comprises a plurality of adjacent grate tubes disposed in the longitudinal direction of said grate and welded together via flat bars and which grate apparatus includes a grate bar carriage disposed below said grate. The grate bar carriage is reciprocable horizontally respective to the grate and supports at least one grate bar which is displaced through the grate via an opening in the flat bar disposed between two adjacent grate tubes when the grate bar carriage moves towards the grate.

The present invention especially relates to a water-cooled grate, which is capable of combusting various solid fuels such as wood fuels and wood waste. As the price of oil rises, fuels such as chips, bark and peat are of especial interest. Uniform combustion of these fuels is, however, difficult to achieve. The fuel mat being conveyed on the grate should be even and proceed in a controlled manner.

Movable grate bars are used for stirring and pushing forward the burning fuel mat. Grate bars are pushed through the grate between the grate tubes via openings in the flat bars by means of which the grate tubes are interconnected - such having been welded together. In the cross direction, for example, every other interspace between the tubes may be provided with grate bars and in the longitudinal direction of the grate, there may be a plurality of such.

The range or stroke of the grate bar carriages supporting the grate bars is generally adjustable as well as the frequency of stroke. The best possible results in burning the fuel mat on the grate with various fuels are achieved by adjusting the stroke length and duration of pauses. The main factor affecting the combustion is, however, air, which is introduced into the fuel from between the grate bars and the grate tubes and flat bars. The grate has to be provided with a certain resistance in order to achieve a pressure difference needed for even conveyance of the air through the grate and for every grate bar to be cooled with air. The pressure loss of the grate is defined in the design stage on the basis of the amount of air flowing through the grate and the cross-section of the flow. The cross-section of the flow equals the slotted area around a grate bar multiplied by the amount of grate bars.

Problematic with the grates have been the changes in the pressure loss of the grate which are caused by manufacturing faults and various heat expansions and deformations also caused by the heat. The slot between the grate bar and flat bar above said grate bar has constituted a special problem. If this slot is too wide, air flows too quickly through the slot, thereby producing a crater in the fuel mat near the slot thus deteriorating the combustion. A decreasing pressure loss also results in that unburned fuel escapes through the grate into the ash hoppers below the grate to reduce the total efficiency of the furnace. The through-flowing fuel may also ignite below the grate, thus damaging the equipment disposed therein.

In the currently built grates, the steel structure of the grate is separated from the tubes of the grate itself. Therefore, in case of different heat expansion in different devices, the air slot either increases or decreases. The air slot may also vary as a result of a fault in manufacture. In such cases, repairs and modifications have to be made to both the flat bars, mostly to the openings therein, and the grate bar carriage. Because of the grate construction, repairs are expensive and time consuming.

An object of the invention is to provide a grate structure free of the drawbacks mentioned above or substantially minimized. It is another object of the invention to provide an apparatus where it is possible to balance the movements between the structures effected by variations in the temperature. It is a further object of the invention to provide a grate apparatus in which the flow of air through the grate can be better adjusted than in earlier, known grate constructions. It is still a further object to provide a grate apparatus which is capable of combusting various wood fuels with an improved fuel economy.

The apparatus of the invention is characterized by members or means for vertical displacement of the grate bar carriage such as defined in claim 1. Other features become apparent from the sub-claims.

Figure 2:
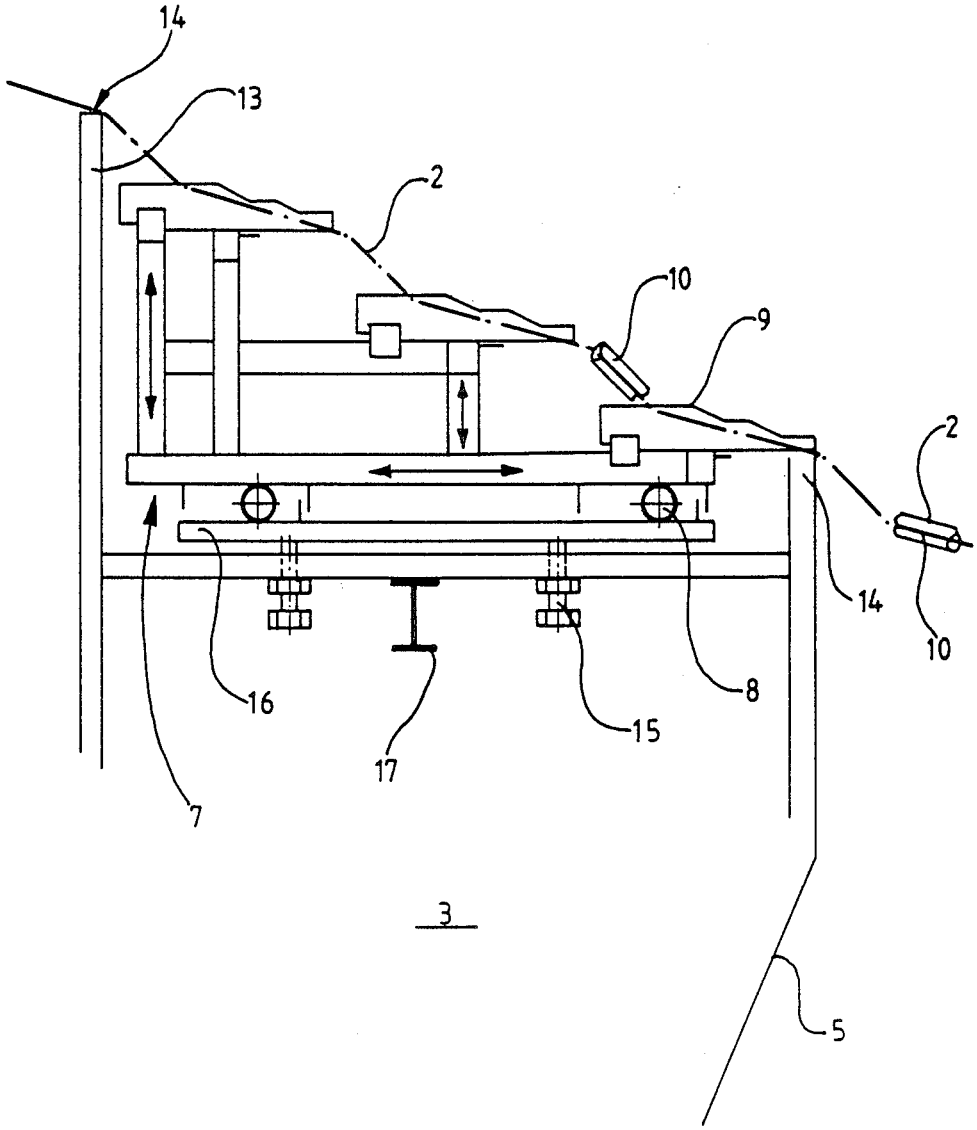
Figure 3:
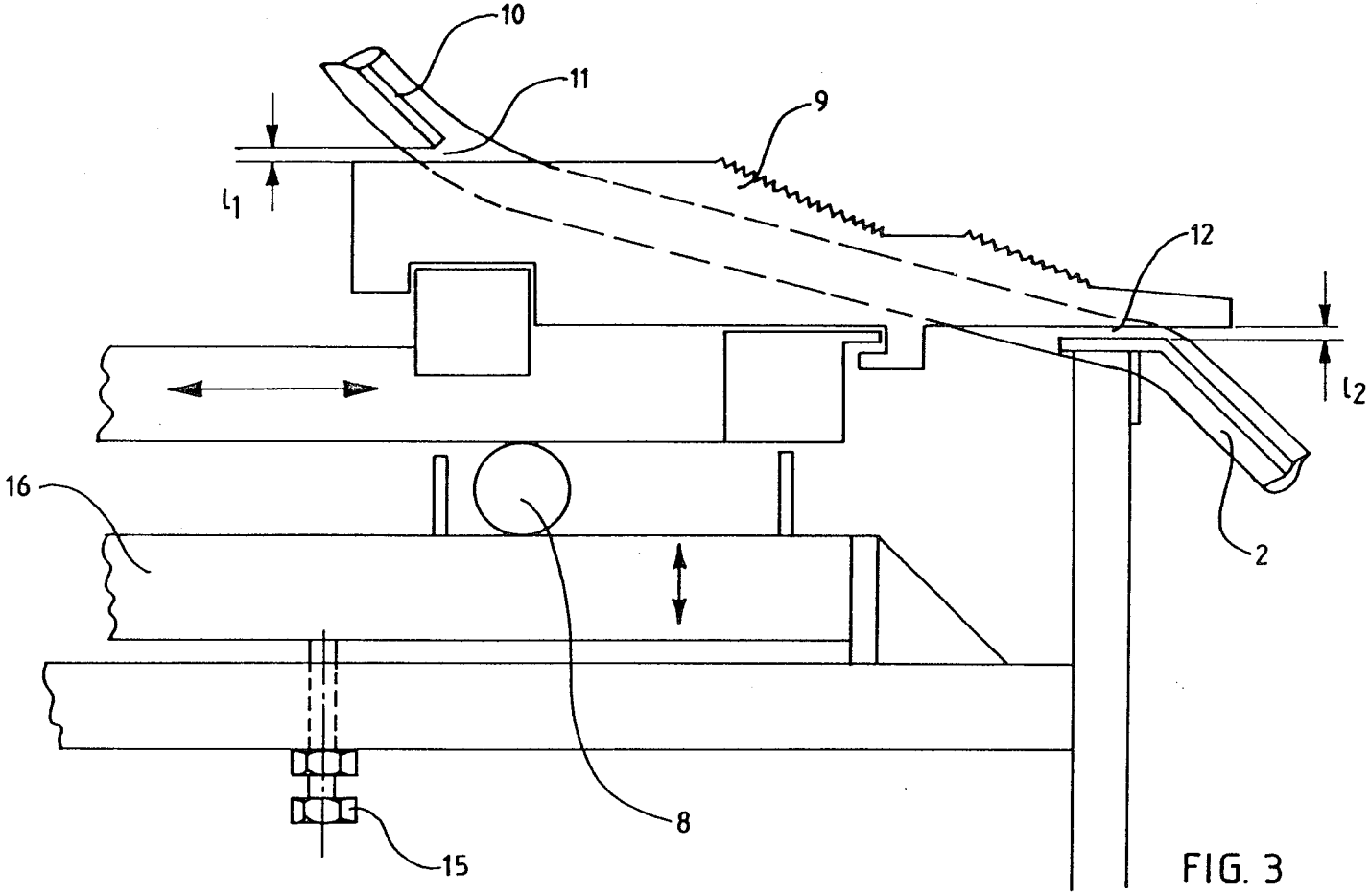
Figure 4:
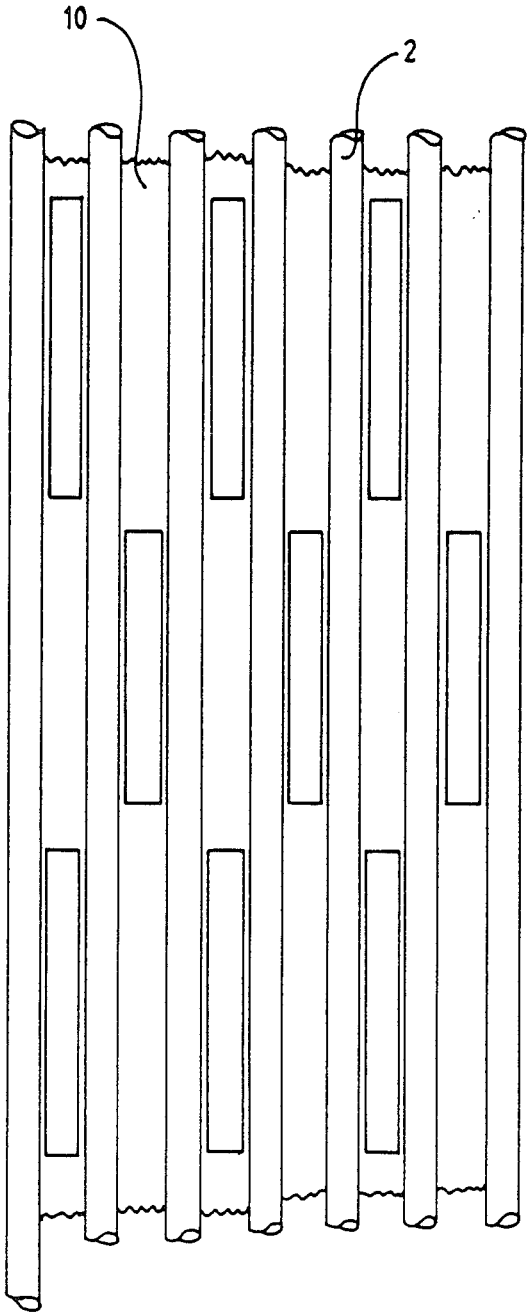

The invention will be described more in detail below by way of example, with reference to the accompanying drawings, in which FIG. 1 is a schematic side view of a grate section in a combustion chamber, FIG. 2 is an enlarged sectional view of a grate bar carriage of FIG. 1, FIG. 3 is an enlarged sectional view of the grate bar of FIG. 2, and FIG. 4 is a fragmentary plan view of the grate section of FIG. 2.

A step grate 1 shown in FIG. 1 comprises a plurality of adjacent, water-cooled tubes 2, only one of which is schematically illustrated in FIG. 1. The lower part of the grate shown in the drawing is divided into three zones 3, whose purpose is to distribute different amounts of air to various zones of a burning fuel mat 4. An adequate number of zones is normally three to five for distributing a suitable amount of air throughout the entire grate. Walls 5 define the zones and also serve as ash hoppers, which convey the ashes and the fuel and sand falling through the grate onto a wet scoop conveyor 6. Separate zones in the direction across the grate are usually unnecessary, but normally there are several grate bar carriages 7 disposed both lengthwise and in the direction across the grate. In bigger grates, there may be even 12 grate bar carriages in use.

The grate bar carriages 7, in use, are reciprocated on rollers 8. The members effecting the movement are not shown in the drawings. When each carriage 7 moves ahead, each grate bar 9 of the carriage is pushed through the opening between the tubes 2 and the flat bars 10 and partly through the grate, as shown in FIGS. 2, 3 and 4. The grate bars simultaneously push fuel downwards and away from the grate, thus effecting the stirring and proceeding of the fuel mat.

Air flows through the grate via slots 11 and 12 between grate bar 9 and flat bars 10. Furthermore, air flows via the slots between tubes 2 and grate bar 9. The slot 11 above the grate bar is only 1 mm long and the slot below the grate bar is only 2 mm long. Even the slightest heat expansion or inaccuracies in the manufacture may increase or decrease the slot dimension with harmful results. Changes in the dimensions of the slots caused by heat expansion and contraction have been substantially decreased by combining the upper sections 14 of the support structures 13 of the carriage, for example, by welding them on to the flat bars 10 between the grate tubes, as shown in the drawings. Thus the grate, grate bar carriages and the supporting steel structure of the grate bar carriages move together under the effect of heat, whereby changes in the dimensions of the slots 11 and 12 caused by variations of temperature, for example, at the start-up are substantially avoided.

The grate bar carriage is vertically adjustable. Changes in the dimensions of the air slots 11 and 12 caused by inaccuracies in the manufacture can be eliminated or minimized by adjusting the height of the grate bar carriage at different points by regulating members 15. The rollers 8, on which the grate bar carriage moves, roll on a base plate 16. By raising or lowering the base plate at one or more edges, for example, by means of regulating screw members 15, the position of the grate bar carriage respective to the openings can be adjusted and the air intake through the grate thus be regulated.

Supporting of the entire grate, grate bar carriages, ash hoppers, grate bars and burning fuel mat is effected by steel beams 17.

I claim:

1. An inclined grate apparatus for use in the combustion chamber of a combustion furnace, comprising:

a grate comprising a plurality of adjacent grate tubes extending longitudinally, and connected together by flat bar means;

a grate bar carriage disposed below said grate, said carriage mounted for horizontal reciprocation relative to the grate, said carriage supporting at least one grate bar, and being mounted so that during use said grate bar is pushed through said grate via an opening in said flat bar means between two adjacent grate tubes when the grate bar carriage moves toward the grate;

means for reciprocating said carriage to effect pushing of said grate bar through said grate; and adjustment means for providing for vertical displacement of said grate bar carriage.

2. Apparatus as recited in claim 1 further comprising a support member disposed below said grate bar carriage, said support member operatively connected to said adjustment means so that it is vertically displaceable by controlling said adjustment means.

3. Apparatus as recited in claim 1 wherein said grate tubes are water cooled.

4. Apparatus as recited in claim 1 further comprising a steel support structure for said grate bar carriage.

5. Apparatus as recited in claim 1 further comprising a plurality of grate bar carriages disposed below said grate in the cross-direction thereof.

6. Apparatus as recited in claim 2 further comprising a plurality of grate bar carriages disposed below said grate in the cross-direction thereof.

7. Apparatus as recited in claim 1 wherein three grate bar carriages are disposed below said grate in the longitudinal direction thereof.

8. Apparatus as recited in claim 1 wherein four grate bar carriages are disposed below said grate in the longitudinal direction thereof.

9. Apparatus as recited in claim 1 wherein five grate bar carriages are disposed below said grate in the longitudinal direction thereof.

10. Apparatus as recited in claim 7 further comprising means for dividing the lower part of said grate into one or more zones so that air can be distributed to the grate.

11. Apparatus as recited in claim 1 further comprising means for dividing the lower part of said grate into one or more zones so that air can be distributed to the grate.

12. Apparatus as recited in claim 1 further comprising a support structure for said grate bar carriage, said support structure affixed to said grate tubes.

13. Apparatus as recited in claim 2 further comprising a support structure for said grate bar carriage, said support structure affixed to said grate tubes.

* * * * *